US005292555A

United States Patent [19]

Preisser

[11] Patent Number: 5,292,555

[45] Date of Patent: Mar. 8, 1994

[54] PROCESS FOR APPLYING NITRIDE LAYERS TO TITANIUM

[75] Inventor: Friedrich Preisser, Buedingen, Fed. Rep. of Germany

[73] Assignee: Degussa Aktiengesellschaft, Frankfurt am Main, Fed. Rep. of Germany

[21] Appl. No.: 984,136

[22] Filed: Dec. 1, 1992

Related U.S. Application Data

[63] Continuation of Ser. No. 665,652, Mar. 7, 1991, abandoned.

[30] Foreign Application Priority Data

Jul. 4, 1990 [DE] Fed. Rep. of Germany ..... 4021286

[51] Int. Cl.[5] ..... C23C 16/00

[52] U.S. Cl. ..... 427/255.1; 427/255.4; 427/295; 427/399

[58] Field of Search ..... 427/255.1, 255.4, 295, 427/399

[56] References Cited

U.S. PATENT DOCUMENTS

| | | | |
|---|---|---|---|
| 2,779,697 | 1/1957 | Chenault | 148/16.6 |
| 4,417,927 | 11/1983 | Fullman | 148/16.6 |
| 4,793,871 | 12/1988 | Dawes et al. | 148/16.5 |

FOREIGN PATENT DOCUMENTS

| | | |
|---|---|---|
| 0105835 | 4/1984 | European Pat. Off. . |
| 0485686 | 5/1992 | European Pat. Off. . |
| 1796212 | 12/1972 | Fed. Rep. of Germany . |
| 2851983 | 6/1980 | Fed. Rep. of Germany . |
| 52-145343 | 12/1977 | Japan . |
| 55-141561 | 11/1980 | Japan . |
| 591528 | 2/1978 | U.S.S.R. . |
| 749992 | 6/1956 | United Kingdom . |
| 1309257 | 3/1973 | United Kingdom . |

OTHER PUBLICATIONS

Patent Abstracts of Japan, vol. 5, No. 124 (C-66)(796) to Ogawa dated Aug. 11, 1981 (Method and Device for Nitrified-Layer Stabilizing Vapor).

Kirk-Othmer *Encyclopedia of Chemical Technology*, 3rd Ed. vol. 15 (1981) pp. 313-323.

*Primary Examiner*—Bernard Pianalto

*Attorney, Agent, or Firm*—Beveridge, DeGrandi, Weilacher & Young

[57] ABSTRACT

An economical process for applying nitride layers to titanium and titanium alloys. Within a short time, layer thicknesses of 20 μm are obtained by pressure-nitriding in an ammonia atmosphere. To this end, temperatures of 500° to 1000° C. and pressures of 0.2 to 9 MPa are used.

25 Claims, 8 Drawing Sheets

PROCESS FOR APPLYING NITRIDE LAYERS TO TITANIUM

CONTINUING APPLICATION DATA

This application is a continuation in part of U.S. patent application Ser. No. 07/665,652, filed Mar. 7, 1991, abandoned which application is entirely incorporated herein by reference.

BACKGROUND OF THE INVENTION

The present invention relates to a process for applying nitride layers to parts composed of titanium and titanium alloys by thermochemical treatment of the parts with ammonia or ammonia-containing gas mixtures under pressures higher than atmospheric pressure and at temperatures above 500° C.

Titanium has some advantages over steel as a construction material, namely its low specific weight, its corrosion-resistance, and its high strength. On the other hand, its hardness is relatively low, which necessitates a surface treatment to increase wear-resistance. This surface treatment generally involves generating layers of titanium carbide or titanium nitride. Processes known hitherto for nitriding parts composed of titanium and titanium alloys involve the use of high-energy gases or electromagnetic fields. These processes are very expensive and are only applicable with parts having a simple geometry.

For example, in German Patent 17 96 212 (which is entirely incorporated herein by reference), the surface hardening of titanium by the formation of nitride layers in an ammonia atmosphere at relatively high temperatures and normal pressure is mentioned. Although the process described in this patent is intended to produce relatively thick, hard layers, this process has no practical application, since the high temperature induces detrimental structural modifications of the core of the component. The component becomes brittle.

Brunner, European Patent Application No. 0,105,835 (which is entirely incorporated herein by reference) describes a process for manufacturing nitride layers on components composed of titanium and titanium alloys by exposing the components in an autoclave to pressures of at least 10 MPa and temperatures of at least 200° C. in an ammonia atmosphere. The actual examples in Brunner use pressures much higher than 10 MPa. For the process of Brunner, the ammonia must be very pure. Preferably, the nitriding takes place at 90 to 130 MPa and temperatures of 930° C. to 1000° C., as shown in Brunner's examples. This process has the disadvantage that it is very expensive due to the use of autoclaves and because very pure ammonia must be used. Furthermore, layers 20 μm thick can be obtained only in treatment periods of three or more hours. Additionally, because of these high pressures, an autoclave is used by Brunner. Because of limitations on the size of autoclaves, large parts and large batches of parts cannot be treated. This makes the process of Brunner economically unfeasible.

SUMMARY OF THE INVENTION

An object of the present invention is to develop a process for applying nitride layers to parts of titanium and titanium alloys by thermochemical treatment of the parts with ammonia or ammonia-containing gas mixtures under pressure and at temperatures of above 500° C.

It is a further object of the invention to provide a process which is economical and which permits nitride layers of 20 μm thick or more to be formed within relatively short treatment time periods.

It is one of the objectives of this invention to avoid the high consumption of ammonia, while still obtaining excellent nitride layers in relatively short treatment times, at greater than atmospheric pressure, but at pressures lower than heretofore considered possible.

These and other objects are achieved according to the invention by carrying out the treatment at temperatures of 500° to 1000° C. and pressures of 0.2 to 9 MPa (2 to 90 bars), wherein the ammonia partial pressure must be at least 0.2 MPa.

In the process for forming nitride layers from ammonia, the ammonia must be dissociated in order to form a reactive gas which includes a reactive nitrogen radical, N*. The dissociation chemical reaction is as follows:

$$2\ NH_3 \rightarrow 2\ N^* + 3\ H_2.$$

This nitrogen radical binds with the titanium on the surface of the titanium component to form the hard titanium nitride layer. The chemical reactions on the surface are as follows:

$$Ti + N^* \rightarrow TiN;\ \text{and}$$

$$2\ Ti + N^* \rightarrow Ti_2N.$$

The ammonia dissociation rate varies inversely with the pressure; i.e., the higher the pressure, the lower the dissociation rate.

However, the rate of titanium nitride formation varies proportionally with the pressure; i.e., the higher the pressure, the faster the rate of titanium nitrogen bonding to form the nitride layer. Accordingly, at very high pressures, such as the pressures used in the Examples of Brunner as described above, a higher concentration of ammonia is necessary in order to provide a higher volume of available nitrogen. This is because at the high pressures in Brunner, the dissociation rate of ammonia is low. Therefore, processes which use very high pressures will also use a large amount of ammonia. Hence, these processes are less economical.

Temperatures of 700° to 950° C. and pressures of 0.5 to 7 MPa have proven particularly advantageous for use in this invention, in which case an ammonia partial pressure of at least 0.2 MPa is necessary. At pressures in the range of above 6 MPa, the nitride layer thickness obtained as a result of the process is almost independent of the pressure.

With the process in accordance with the invention, components composed of titanium and titanium alloys of any shape and size can be provided with sufficiently thick nitride layers of 20 μm and more in chamber furnaces. Surprisingly, extremely pure reaction gases are not necessary, but the normal commercial-quality ammonia may be used. Furthermore, it is possible to mix nitrogen with the ammonia, in which case only an ammonia partial pressure of at least 0.2 MPa is needed for the nitriding process.

The thickness of the titanium nitride layers formed in this process is dependent, within wide pressure ranges, on the temperature and treatment duration. The nitrided surface is golden in color and has a significant increase in hardness as compared to untreated material.

The process in accordance with the invention provides a method for nitriding titanium parts, including titanium parts having complex geometries. The process is simple, avoids the formation of a white layer, and is simple to operate and clean up.

BRIEF DESCRIPTION OF THE DRAWINGS

The invention will be described in more detail in conjunction with the attached figures, wherein.

DETAILED DESCRIPTION OF THE INVENTION

The following description provides detailed information for carrying out the invention.

Figure 1:
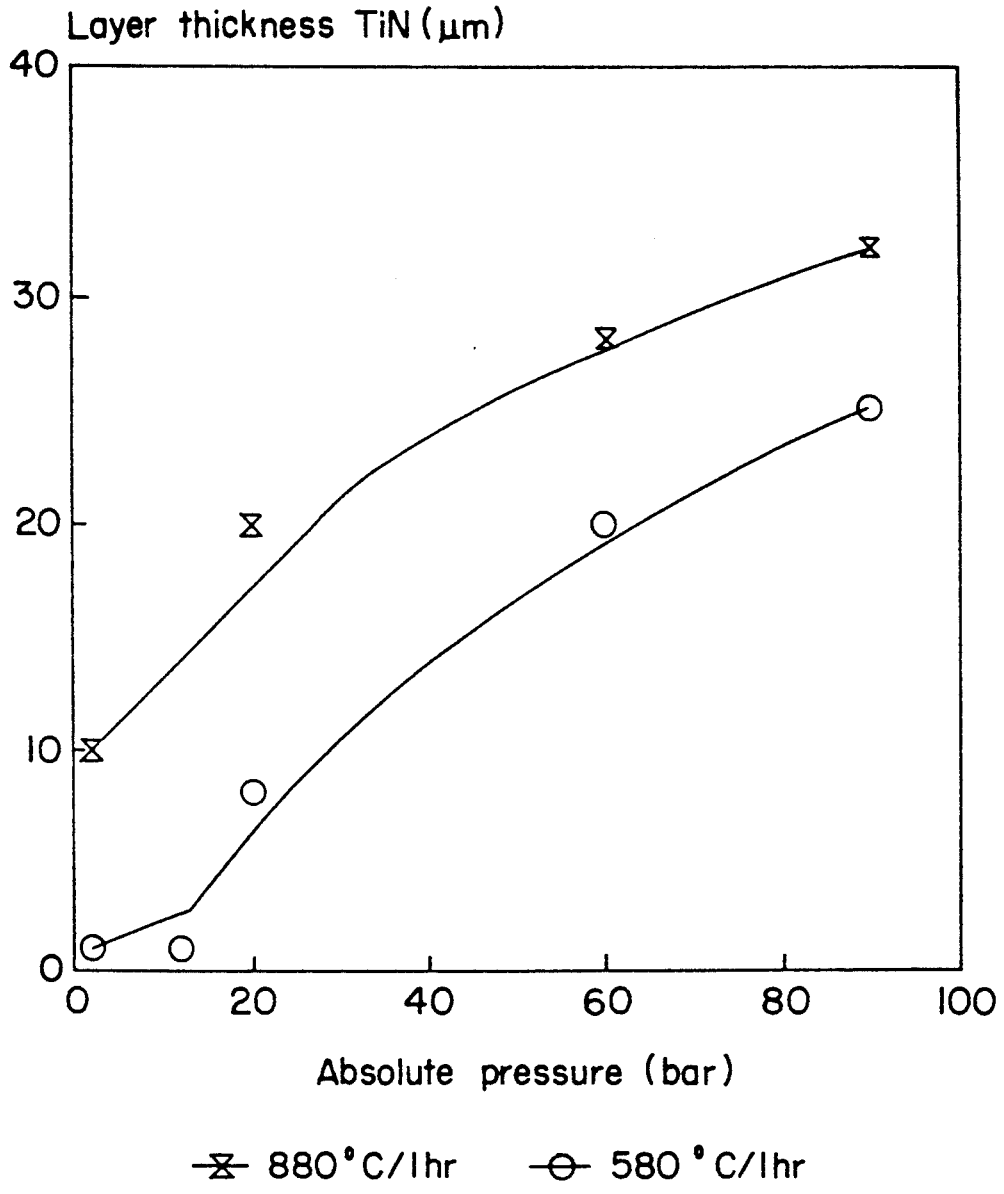
FIG. 1 is a graph showing the thickness of a titanium nitride layer on parts composed of pure titanium as a function of the pressure and temperature of the ammonia-containing atmosphere.

FIG. 1 is a graph which shows the thickness of the titanium nitride layer (TiN) as a function of the pressure at 580° C. and 880° C. The pressure range shown in this graph is about 0.2 MPa (2 bar) to about 9 MPa (90 bar). In each case, the treatment time was one hour.

As shown in the graph of FIG. 1, at 580° C. and 2 MPa (20 bar) absolute pressure, after one hour a TiN layer of about 10 μm thick was produced. At 880° C., in one hour, a pure TiN layer of about 20 μm is built up when the pressure is 2 MPa (20 bar).

By increasing the pressure to 6 MPa (60 bar), a TiN layer of about 30 μm is built up, for example, if the samples are kept at 880° C. for one hour. FIG. 1 also shows that at 580° C. and 6 MPa for one hour, an approximately 20 micron TiN layer is provided.

At a further increment of pressure to 9 MPa (90 bar), the effect of the pressure on the thickness of the TiN layer decreases. After one hour at 9 MPa, the TiN layer was approximately 23 microns at a treatment temperature of 580° C., and the TiN layer was about 31 microns at a treatment temperature of 880° C. However, the increase in the titanium nitride layer thickness is no longer a linear function of the pressure. At even higher pressures, due to the rapidly forming dense TiN layer, only the diffusion of nitrogen through the layer is the time-determining factor.

The results shown in FIG. 1 indicate that the effect of the invention can be achieved in less than 3 hours, typically less than 2 hours. In accordance with the invention, satisfactory layer thicknesses can be obtained in relatively short times, for instance in 1 or 2 hours. However, increased treatment times up to 4 hours also provide good nitride layers.

In the same way as pure titanium, titanium alloys, such as $TiAl_6V_4$, can be nitrided by the process in accordance with this invention.

The flow velocity of the ammonia in the process is not critical. A considerable advantage of the invention resides in the fact that no pretreatment of the metal surface is needed before carrying out the process of the invention.

The invention can be used for the manufacture of many varied types of parts, such as turbine blades, gears, valves, pump parts and the like, especially parts for operation in aggressive environments, such as where the metal is exposed to corrosion, high temperatures or high pressures. Also, the invention is well suited for the treatment of machine parts that are subject to rapid motion in operation. Still further, the invention can be used to treat clock and watch cases, eye glass parts, and fuel injection nozzles.

The protective nitride layers formed on the titanium bases can range typically from 2 to 50 microns thick, depending on temperature, pressure and duration of treatment. Preferably, the nitride thickness ranges from 10 to 30 microns.

For these coatings, no autoclave is needed, but the treatment can take place in a standard commercial chamber furnace, such as the vacuum ovens manufactured by Degussa AG known as "VKP gr". The elimination of the autoclave, such as used by Brunner (EP-A-0,105,835), is believed to be a significant advantage of this invention. Autoclaves are typically smaller than the chamber furnaces, thus, in accordance with the process of the invention, a larger number of parts can be treated in a single treatment process. Furthermore, when using an autoclave, the internal pressure increases as the temperature in the autoclave is increased. However, when a chamber furnace is used, such as the above identified vacuum ovens, the pressure may be independently regulated during the heating cycle so that a relatively constant pressure can be maintained during the treatment process.

The following Table shows a direct comparison between the process in accordance with the invention and the process according to Example 2 in Brunner, European Patent App. No. 0,105,835.

TABLE 1

| | | Process in accordance with invention | | EPA 0,105,835 Example 2 |
|---|---|---|---|---|
| 1. | Base material | TiAl6V4 | TiAl6V4 | TiAl6V4 |
| 2. | Temperature | 930° C. | 930° C. | 930° C. |
| 3. | Pressure | 1.2 MPa (* | 1.2 MPa (* | 130 MPa |
| 4. | Treatment time (hours) | 3 h | 1 h (** | 3 h |
| a. | Thickness of TiN layer | 6 μm | 3 μm | unknown |
| b. | Thickness of diffusion layer | 18 μm | 9 μm | unknown |
| c. | Thickness of hardened layer (= a + b) | 24 μm | 12 μm | 12 μm |
| d. | Surface hardness | HV 1300 (*** | HV 800 | HV 800 |

(* Remark: The amount of gas necessary is only 1/100 of the Brunner process.
(** Remark: Treatment time is only ⅓ of the Brunner process.
(*** Remark: Surface hardness is much higher than in the Brunner example.

As can be seen from Table 1, the volume of gas needed for the process in accordance with the invention is about 1/100 of the volume needed for a comparable run of the process in accordance with Brunner, because of the large difference in gas pressure (1.2 MPa versus 130 MPa). Furthermore, treatment times can be much shorter in the process in accordance with the invention, while still obtaining a comparable nitride layer. Note that a one hour treatment time is used in accordance with the invention versus a three hour treatment time in the Brunner process, whereas both processes provide a 12 μm nitride layer. Alternatively, if the nitriding process in accordance with the invention is run for 3 hours (as also shown in Brunner) a 24 μm hardened layer is obtained (compared to 12 μm in Brunner) having a higher hardness (as measured by Vickers' Hardness Number; HV 1300 versus HV 800 for the Brunner process).

Figure 2:
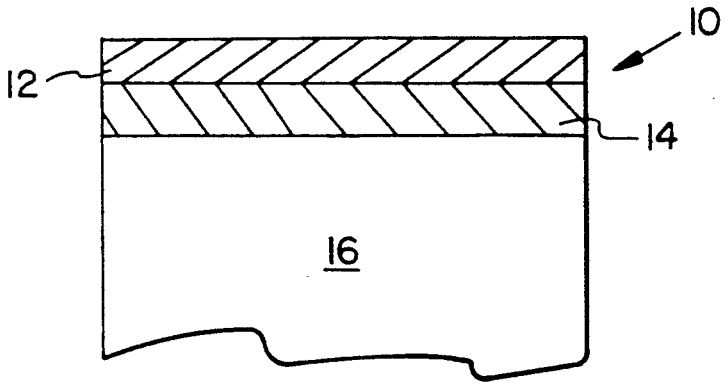
FIG. 2 is a schematic view of the titanium part including the nitrided layer and the diffusion layer.

FIG. 2 is a schematic diagram showing a typical titanium component or titanium alloy 10 after the nitriding treatment in accordance with the invention. The top layer 12 in FIG. 2 represents the titanium nitride layer. This layer is also called the "compound layer" in this specification. Layer 14 is called the diffusion zone. The diffusion zone 14 includes a mixed layer of the titanium metal or alloy with titanium nitride and nitrogen dispersed through the layer by diffusion. The titanium metal or titanium alloy base is shown at 16. A typical titanium alloy used in the process in accordance with this invention is $TiAl_6V_4$. Typically, the nitride layer 12 may be as much as 50 microns thick. The diffusion layer 14 may be 10 microns thick or even thicker.

Figure 3:
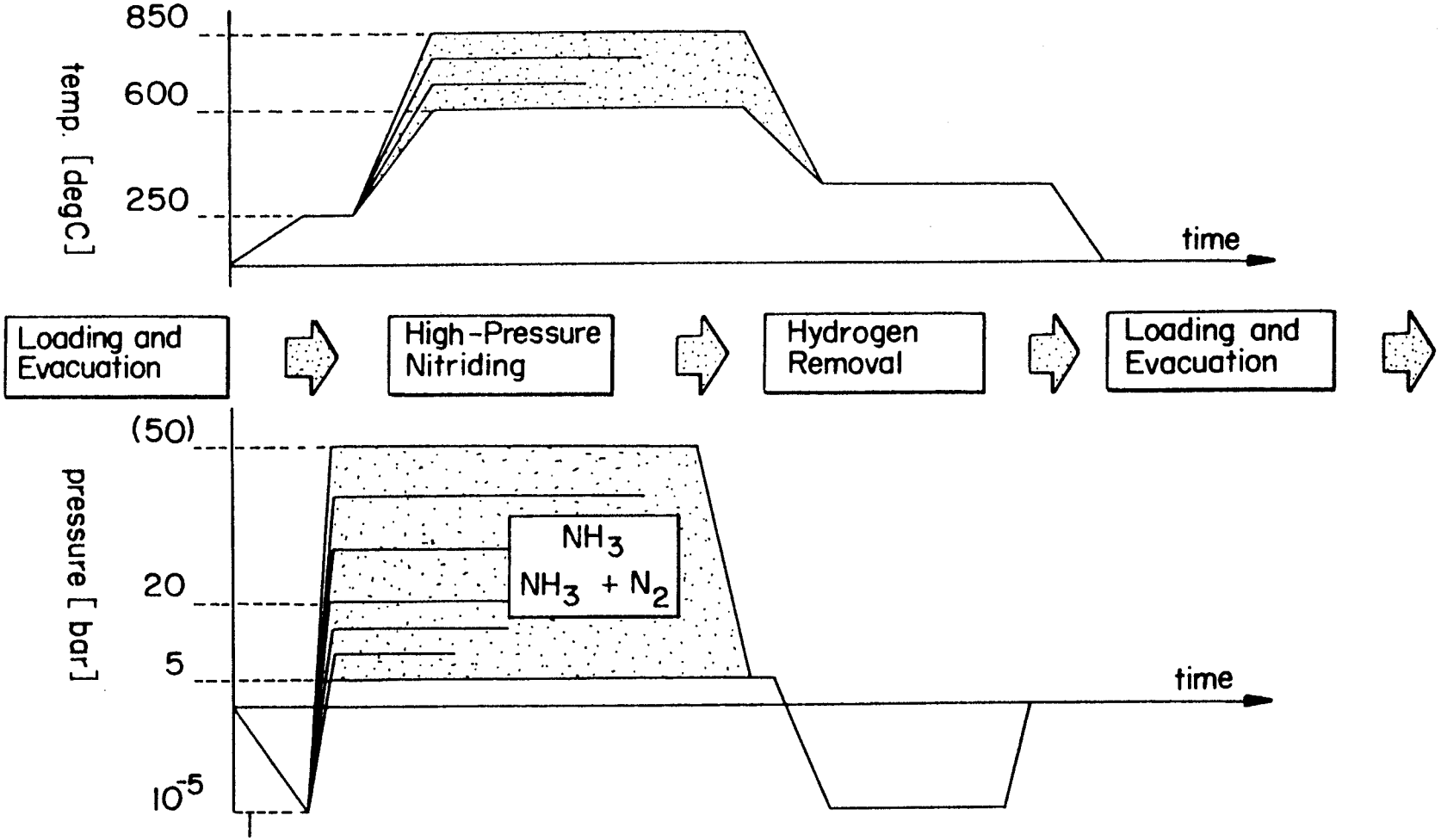
FIG. 3 is an overview of a process cycle in accordance with the invention showing the temperature and pressure at various stages in a nitriding process.

FIG. 3 shows a typical process cycle for performing the process in accordance with this invention. Time is shown on the horizontal axis in FIG. 3, and temperature and pressure are shown on the vertical axes. In the process cycle shown in FIG. 3, initially, the components to be nitrided are loaded in the chamber furnace and the furnace is evacuated. This evacuation may be to a pressure as low as $10^{-5}$ bars. During evacuation, the temperature in the furnace is steadily increased to 250° C.

After the temperature reaches 250° C. and while maintaining the temperature at approximately a constant level, ammonia gas alone, or ammonia gas mixed with nitrogen is fed into the chamber furnace until the desired pressure level is reached. FIG. 3 shows various pressures ranging from 5 bars to 50 bars, although higher or lower pressures may be used, as described above.

Once the desired pressure level is attained, the temperature in the chamber furnace is increased to the final desired temperature level. The pressure is maintained essentially constant during the temperature increase. FIG. 3 shows various temperatures ranging from 600° to 850° C., although higher or lower temperatures may be used, as discussed above.

While the temperature is being increased to the desired temperature level, and while the temperature and pressure are being maintained at their respective levels, the nitriding reaction is taking place. The temperature and pressure are maintained at their respective levels for the desired reaction time, depending on the thicknesses of the nitride layer which is desired. Typically, this time period may be up to four hours (240 minutes), although treatment times of 1-3 hours are preferred.

After the treatment is completed, the pressure in the chamber furnace is released, and the temperature is decreased. The furnace is then evacuated to remove the hydrogen which was liberated during the dissociation of the ammonia. This evacuation may be to $10^{-5}$ bars, although other evacuation pressures may be used. After the hydrogen removal step, the furnace is opened to the atmosphere and the nitrided components are unloaded. The furnace may be again loaded with a new charge of titanium parts for the next treatment process.

Figure 4:
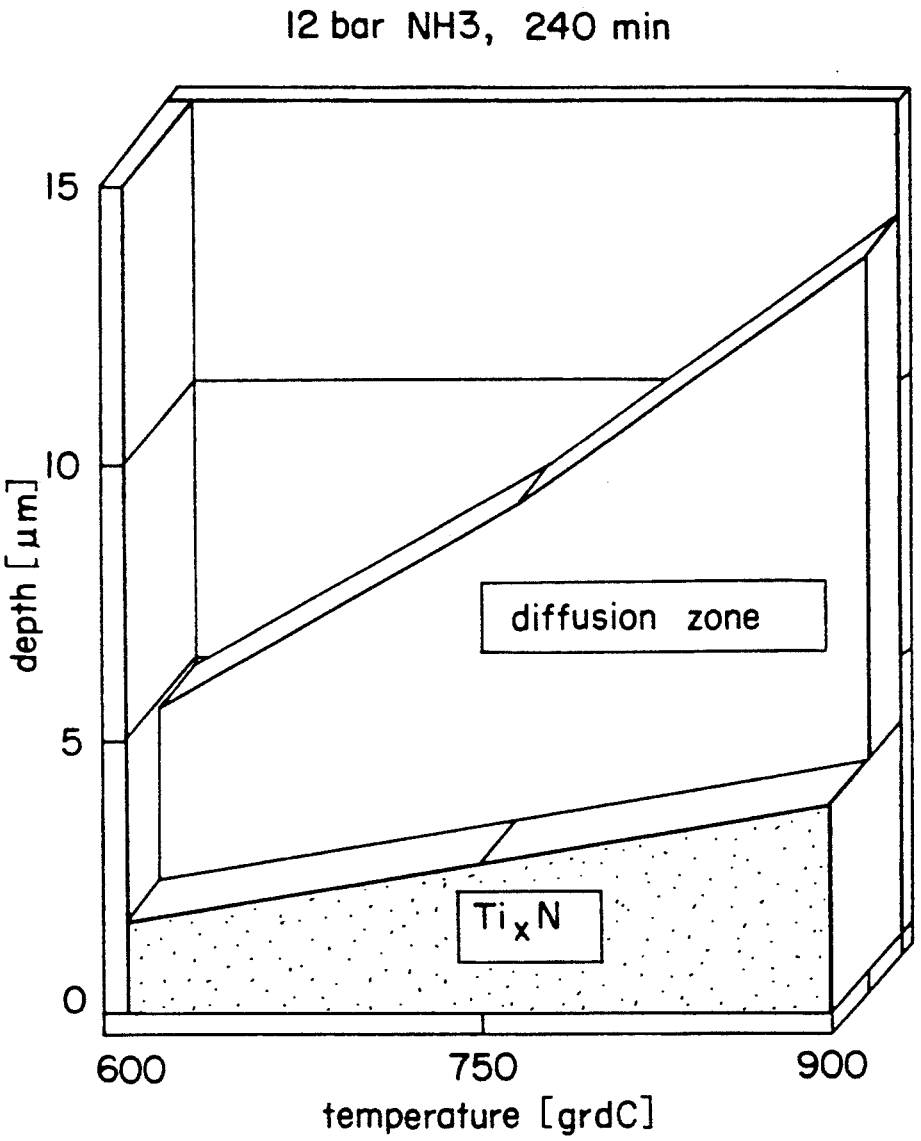
FIG. 4 is a graph showing the thicknesses of the titanium nitride layer and the diffusion zone on a titanium alloy.

FIG. 4 is a graph which shows the thickness of the titanium nitride layer and the diffusion zone produced on a titanium alloy of $TiAl_6V_4$ as a function of the treatment temperature. For obtaining the data shown this graph, the treatment gas was ammonia at 12 bars (1.2 MPa), and the treatment time was 4 hours (240 minutes). As shown in the graph, the titanium nitride layer thickness and the diffusion zone thickness each steadily increased as the temperature increased. At about 600° C., the nitride layer was about 2 microns thick and the diffusion zone was approximately another 3 microns, for a total nitride layer thickness and diffusion zone thickness of about 5 microns. At 900° C., the nitride thickness was about 4 microns and the diffusion zone thickness was about 9 microns, for a total thickness of about 13 microns.

Figure 5:
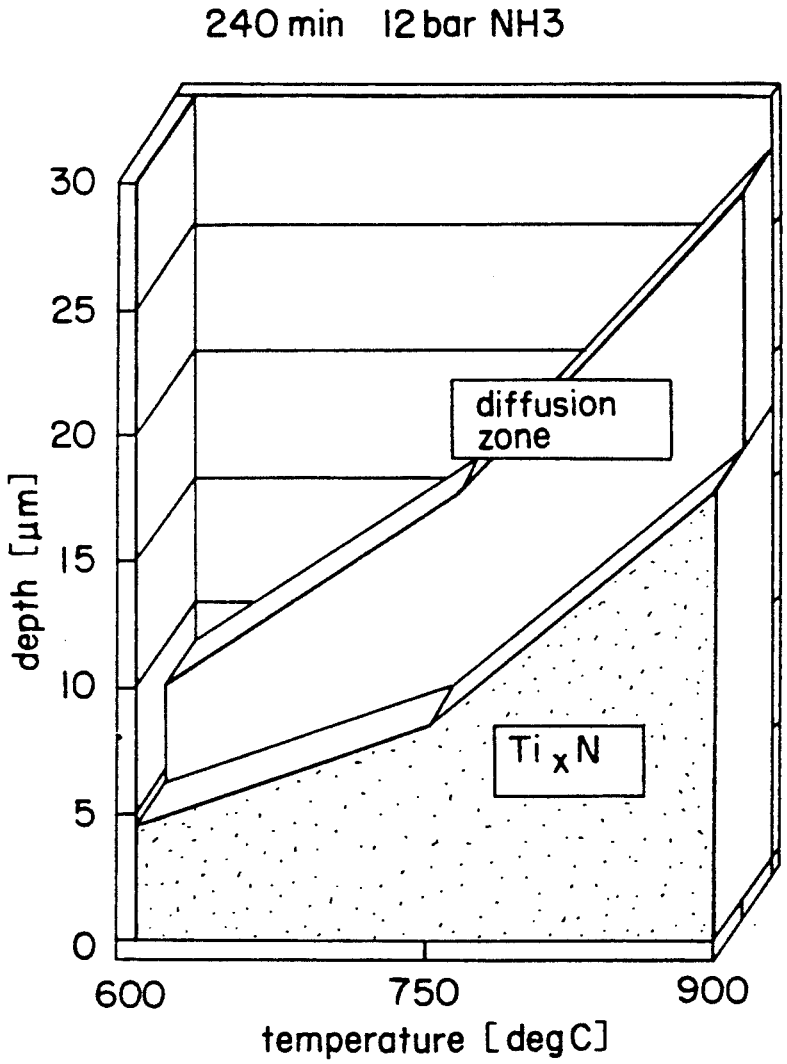
FIG. 5 is a graph showing the thicknesses of the titanium nitride layer and the diffusion zone on a pure titanium part.

FIG. 5 is similar to FIG. 4, except the treatment process in FIG. 5 is performed on pure titanium parts, as opposed to the titanium alloy of FIG. 4. This graph shows the thickness of the titanium nitride layer and the diffusion zone as a function of the treatment temperature. As was the case for FIG. 4, the treatment gas was ammonia at 12 bars (1.2 MPa), and the treatment time was 4 hours (240 minutes). Again, the titanium nitride layer thickness and the diffusion zone thickness each steadily increased as the temperature increased. At about 600° C., the nitride layer was about 5 microns thick and the diffusion zone was approximately another 3 microns, for a total nitride layer thickness and diffusion zone thickness of about 8 microns. At 900° C., the nitride thickness was about 17.5 microns and the diffusion zone thickness was about 10 microns, for a total thickness of about 27.5 microns.

Figure 6:
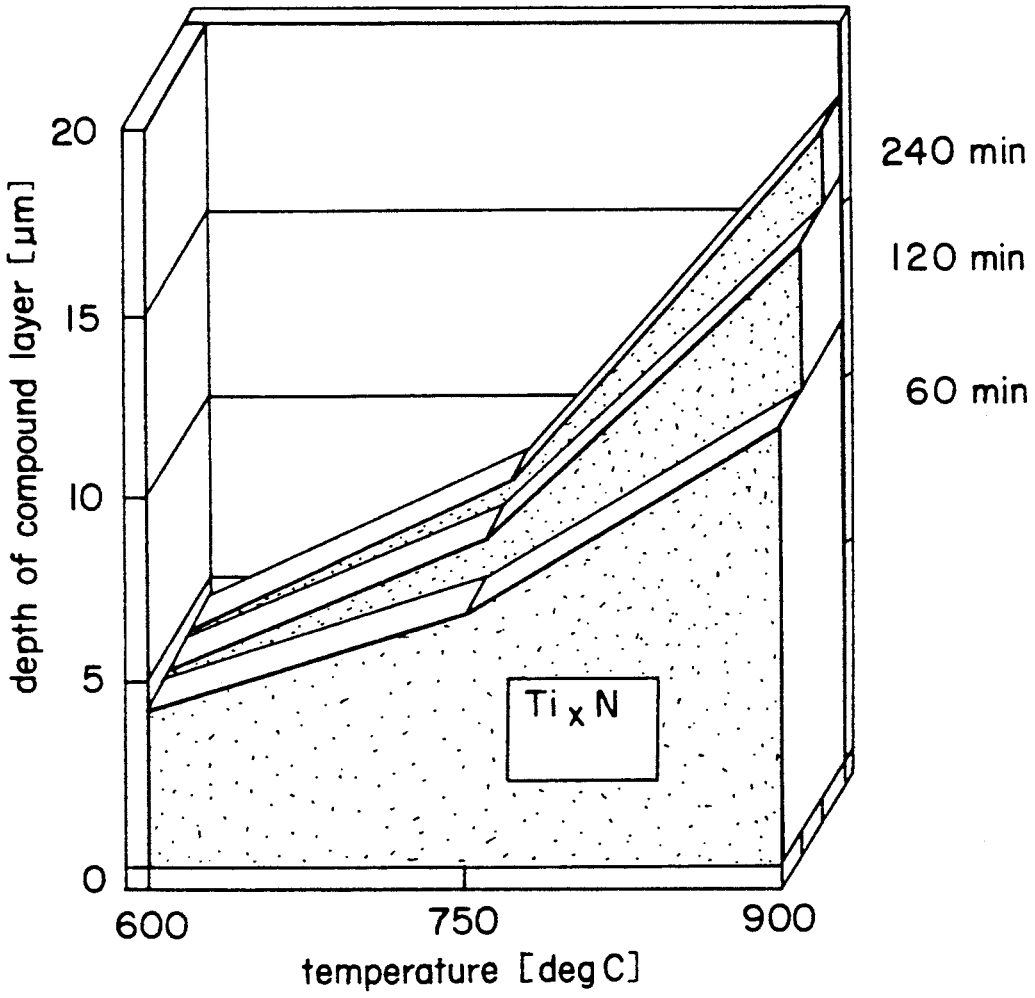
FIG. 6 is a graph showing the thickness of the titanium nitride layer on a pure titanium part as a function of the temperature and the treatment time.

The thickness of the compound layer (i.e., the nitride layer) is shown in FIG. 6 as a function of the treatment temperature and the treatment time. As above, the treatment gas was ammonia under 12 bars of pressure. Generally, as shown in the graph, at low temperatures, the compound layer thickness is almost independent of the treatment time. However, at higher temperatures, the compound layer thickness increases with increasing treatment time.

The data from FIG. 6 is summarized in Table 2.

TABLE 2

| Temperature | Treatment Time | Nitride Layer Thickness |
|---|---|---|
| 600° C. | 60 min. | approx. 4.2 microns |
| 600° C. | 120 min. | approx. 4.3 microns |
| 600° C. | 240 min. | approx. 4.4 microns |
| 750° C. | 60 min. | approx. 7 microns |
| 750° C. | 120 min. | approx. 8 microns |
| 750° C. | 240 min. | approx. 8.5 microns |
| 900° C. | 60 min. | approx. 12 microns |
| 900° C. | 120 min. | approx. 16 microns |
| 900° C. | 240 min. | approx. 17.5 microns |

Figure 7:
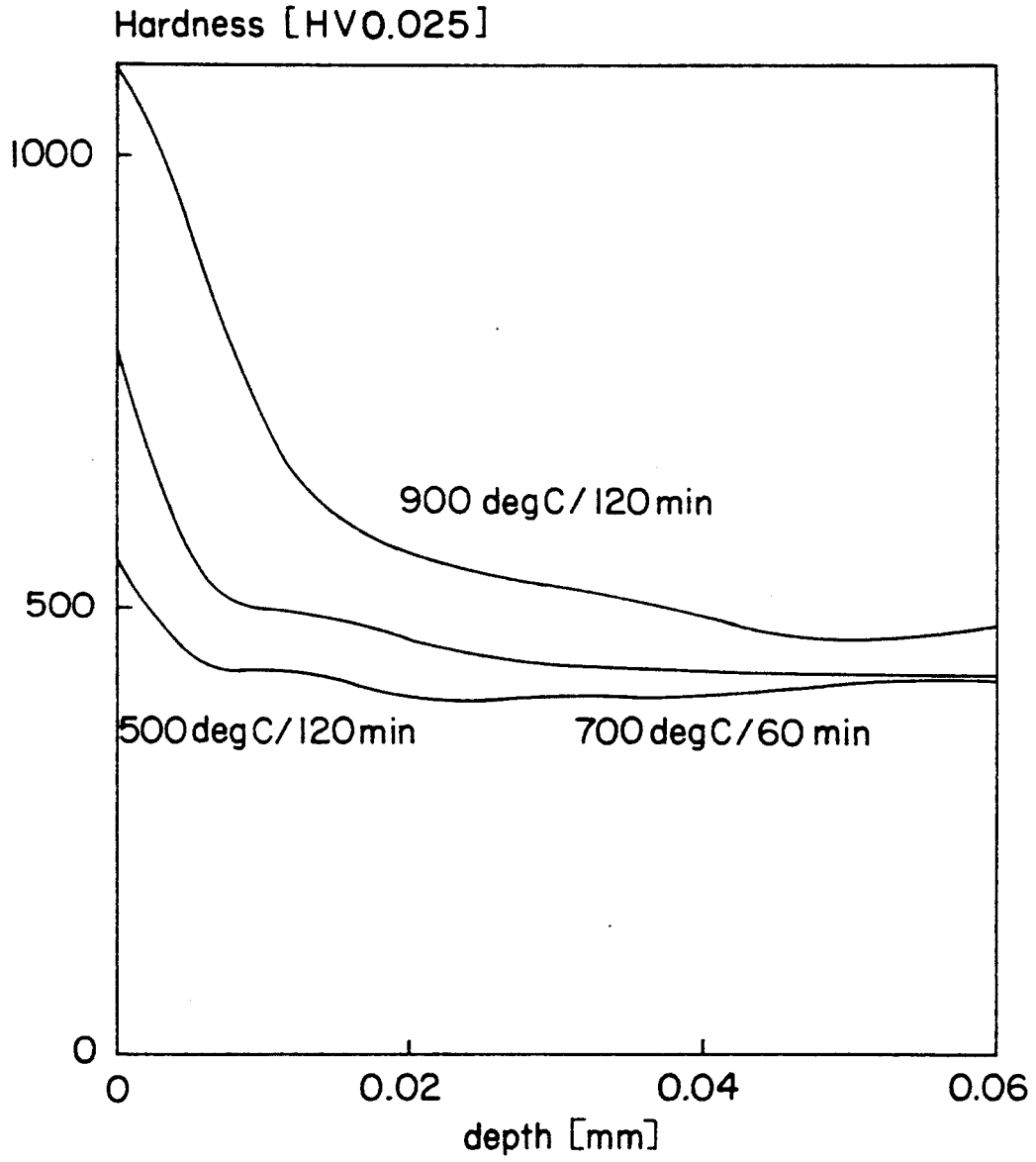
FIG. 7 is a hardness diagram for various titanium nitride layers on a titanium alloy.
Figure 8:
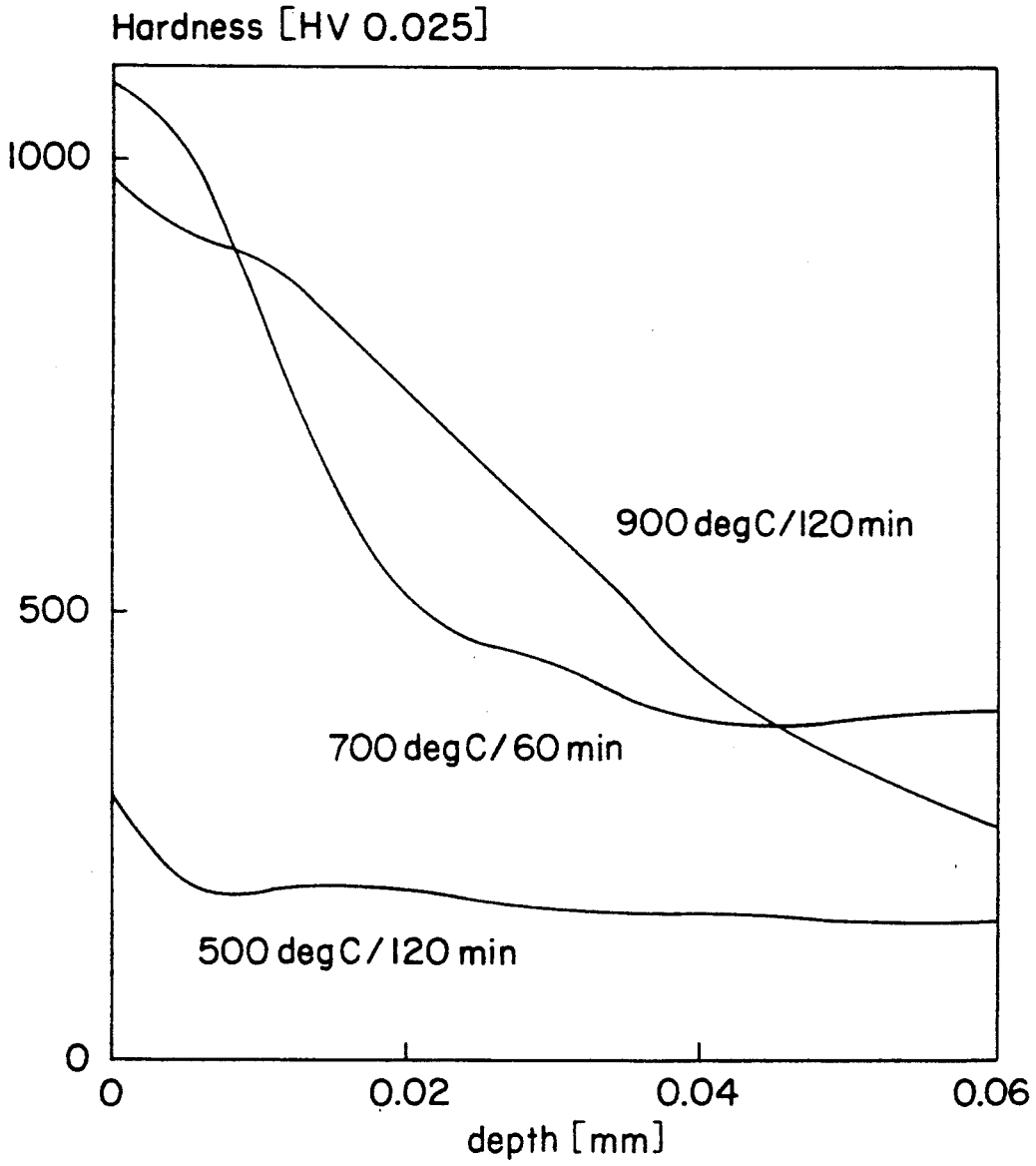
FIG. 8 is a hardness diagram for various titanium nitride layers on a pure titanium part.

FIGS. 7 and 8 show hardness charts for the titanium alloy $TiAl_6V_4$ and pure titanium, respectively, for three different treatment process cycles. All of the treatment processes in these figures were carried out in ammonia at 12 bars. The first treatment cycle is at a temperature of 500° C. for 2 hours (120 minutes). The second treatment cycle is at 700° C. for 1 hour (60 minutes). The third treatment cycle is at 900° C. for 2 hours. The hardness was measured by the Vickers' hardness measuring technique, which technique is known to those skilled in the art.

Further variations and modifications of the invention may be made and will be apparent to those skilled in the art from the foregoing and are intended to be encompassed by the claims appended hereto.

German priority application P 40 21 286.6-45 is relied on and incorporated herein by reference.

I claim:

1. A process for applying a nitride layer to a part made of titanium, a titanium alloy or a mixture thereof, comprising: contacting said part in a thermochemical treatment with ammonia or ammonia-containing gas mixture in a chamber furnace at a temperature of 500° to 1000° C. and under a pressure of 0.2 to 9 MPa, wherein the ammonia partial pressure is at least 0.2 MPa.

2. The process for applying nitride layers according to claim 1, wherein the treatment takes place at a temperature of 700° to 950° C. and at a pressure of 0.5 to 7 MPa.

3. The process according to claim 1, wherein no pretreatment is carried out.

4. The process according to claim 1, wherein the thickness of the layer is from 2 to 50 microns.

5. The process according to claim 4, wherein the thickness of the layer is in the range of from 10 to 30 microns.

6. The process according to claim 1, wherein the nitride layer is formed in one to three hours.

7. The process according to claim 1, wherein the nitride layer is formed in one to two hours.

8. The process according to claim 1, wherein the part to be treated is a part selected from the group consisting of turbine blades, gears, valves, pump parts, clock cases, watch cases, eye glass parts, and fuel injection nozzles.

9. The process according to claim 1, wherein the chamber furnance is a vacuum oven.

10. The process according to claim 1, wherein the part is a titanium alloy of the formula $TiAl_6V_4$.

11. The process according to claim 1, wherein the nitride layer is formed in less than two hours.

12. A process for forming a nitride layer on a part made of titanium, a titanium alloy or a mixture thereof, comprising:

loading the part into a chamber furnace;

evacuating the chamber furnace to a subatmospheric pressure in a first evacuation step;

inputting ammonia gas or an ammonia containing gas mixture into the chamber furnace to thereby increase a pressure in the furnace to the range of 0.2 to 9 MPa;

contacting the part in a thermochemical treatment with the ammonia or ammonia-containing gas mixture at a temperature in the range of 500° to 1000° C., wherein the ammonia partial pressure is at least 0.2 MPa, for a sufficient period of time to provide the nitride layer on at least a portion of the part;

evacuating the furnace chamber to a subatmospheric pressure to remove hydrogen liberated during the treatment in a second evacuation step; and recovering the part having the nitride layer formed thereon.

13. The process for applying nitride layers according to claim 12, wherein the contacting takes place at a temperature in the range of 700° to 950° C. and at a pressure in the range of 0.5 to 7 MPa.

14. The process according to claim 12, wherein the thickness of the layer is from 10 to 30 microns.

15. The process according to claim 12, further comprising increasing the temperature in the chamber during the first evacuation step.

16. The process according to claim 12, further comprising holding the temperature in the chamber essentially constant during the step of inputting the ammonia gas or ammonia containing gas.

17. The process according to claim 16, further comprising that after the ammonia gas or ammonia containing gas has been input into the furnace chamber and the pressure in the chamber furnace is attained, increasing the temperature in the chamber furnace while maintaining the pressure at essentially a constant level.

18. The process according to claim 12, further comprising maintaining the pressure in the chamber furnace at essentially a constant level during the contacting step.

19. The process according to claim 12, further comprising maintaining the chamber furnace at essentially a constant treatment temperature during the contacting step, once the treatment temperature is attainted in the furnace during the contacting step.

20. The process according to claim 12, wherein the contacting step is two hours or less.

21. The process according to claim 12, wherein the contacting step is from one to two hours.

22. The process according to claim 12, wherein the chamber furnace is a vacuum oven.

23. The process according to claim 12, wherein the part is a titanium alloy of the formula $TiAl_6V_4$.

24. The process according to claim 12, wherein the part is titanium metal.

25. A processes for forming a nitride layer on a part made of titanium, a titanium alloy or a mixture thereof, comprising:

loading the part into a chamber furnace;

inputting ammonia gas or an ammonia containing gas mixture into the chamber furnace to thereby increase a pressure in the furnace to the range of 0.2 to 9 MPa;

contacting the part in a thermochemical treatment with the ammonia or ammonia-containing gas mixture at a temperature in the range of 500° to 1000° C., wherein the ammonia partial pressure is at least 0.2 MPa, for a sufficient period of time to provide the nitride layer on at least a portion of the part; and evacuating the furnace chamber to a subatmospheric pressure to remove hydrogen liberated during the treatment.

* * * * *